US005386668A

United States Patent [19]

Mügge et al.

[11] Patent Number: 5,386,668

[45] Date of Patent: Feb. 7, 1995

[54] BLASTING PLANT HAVING BLAST WHEELS ABOVE AND BELOW FOR BLASTING ELONGATED WORKPIECES

[75] Inventors: Hans-Jürgen Mügge, Karlsruhe; Bernhard S. A. Neumaier, Linkenheim-Hochstetten; Wolfgang Heiss, Stutensee, all of Germany

[73] Assignee: BMD Badische Maschinenfabrik Durlach GmbH, Karlsruhe, Germany

[21] Appl. No.: 59,963

[22] Filed: May 13, 1993

[30] Foreign Application Priority Data

May 15, 1992 [DE] Germany ..... 4216108

[51] Int. Cl.[6] ..... B24C 5/00

[52] U.S. Cl. ..... 451/91; 451/75; 451/80; 451/81; 451/95

[58] Field of Search ..... 51/410, 417, 418, 426, 51/428, 429, 432, 434, 317, 319, 320, 321

[56] References Cited

U.S. PATENT DOCUMENTS

| | | | |
|---|---|---|---|
| 2,131,767 | 10/1938 | Turnbull | 51/418 |
| 2,195,810 | 4/1940 | Bower | 51/417 |
| 3,031,802 | 5/1962 | Leliaert | 51/417 |
| 3,716,947 | 2/1973 | Carpenter et al. | 51/417 |
| 4,254,593 | 3/1981 | Paulfeuerborn | 51/425 |

FOREIGN PATENT DOCUMENTS

| | | |
|---|---|---|
| 1815187 | 10/1969 | Germany . |
| 3039028 | 5/1982 | Germany . |
| 726744 | 3/1955 | United Kingdom . |
| 1067451 | 5/1967 | United Kingdom . |

*Primary Examiner*—Bruce M. Kisliuk
*Assistant Examiner*—Eileen P. Morgan
*Attorney, Agent, or Firm*—Antonelli, Terry, Stout & Kraus

[57] ABSTRACT

A blasting plant for elongated components, such as girders, welded structures, etc., has a blast cabinet, a conveyor for conveying the components through the blast cabinet and centrifugal blast wheels positioned below and above the same and whose blast medium jets are directed against the traversing component, and at least one deflecting device, which is associated with at least one centrifugal blast wheel and deflects the blast medium jet thereof. In order to effectively blast the leading and trailing faces of the component or top or cover plates located there, the deflecting device is adjustable between an inoperative position outside the blast medium jet and an operative position deflecting the same with respect to the vertical in the conveying direction and at least one second deflecting device is provided, which is adjustable between an inoperative position outside the blast medium jet and an operative position deflecting the same relative to the vertical counter to the conveying direction.

11 Claims, 3 Drawing Sheets

BLASTING PLANT HAVING BLAST WHEELS ABOVE AND BELOW FOR BLASTING ELONGATED WORKPIECES

FIELD OF THE INVENTION

The invention relates to a blasting plant for elongated components, such as girders, welded structures, etc., having a blast cabinet, a conveyor means conveying the components substantially horizontally through the blast cabinet and centrifugal blast wheels arranged above and below the conveying means, whose blast medium jets are directed against the component passing through, and with at least one deflecting device, which is associated with a centrifugal blast wheel and deflects the blast medium jet thereof.

BACKGROUND OF THE INVENTION

In the case of elongated components, such as sections, girders, steel welded structures, etc., blasting for the removal of rust, scale, welding slag, etc. generally takes place in a continuous process, in that the components are conveyed on a conveyor means through the blast cabinet and during the conveying movement are blasted by means of centrifugal blast wheels arranged in fixed manner within the cabinet. Much the same occurs for the blasting of metal plates, wires, etc.

The centrifugal blast wheels of a blasting plant always supply the blast medium or abrasive in a specific direction and with a specific blast angle (jet aperture angle). Apart from the speed and particle size of the blast medium, these two parameters are decisive for the quality of the surface treatment. However, the jet must be oriented in such a way that the blast medium does not remain on the component and does not cover as yet unblasted surfaces during the blasting operation, because this would lead to a considerable reduction in the effectiveness of the action of the jet on the covered surfaces. It is therefore known in connection with moving articles (CH 447 864), to position the centrifugal blast wheels in such a way that the blast medium jet strikes the workpiece in sloping manner from the side and therefore the particles are deflected to the side. Use is made of two oppositely directed centrifugal blast wheels, which are pivotably mounted about an axis in such a way that the impact angle and the width of the blast medium cone on impact can be varied, so as in this way to be able to modify the blasting area and so as to be able to effectively deal with workpieces of different widths. Other known mechanisms (DE 442 768, U.S. Pat. Nos. 3,277,608, 2,295,926), have similar aims, with the blast medium jet being narrowable or widenable by plate like deflecting devices.

It is also known in connection with the blasting of wires (DE 18 15 187, 28 51 173, 28 57 609), to focus the blast medium jet onto the wire through deflecting devices acting from either side.

In the case of sections, girders, welded structures and the like having larger cross-sections generally the top and bottom, as well as the lateral faces can be subject to effective blasting treatment in that several centrifugal blast wheels are positioned above and below the conveyor means. Generally the centrifugal blast wheels are positioned in a plane perpendicular to the conveying direction and each centrifugal blast wheel supplies the blast medium jet in this plane under a different angle to the moving component, so as to effectively cover all surfaces. However, it is not possible to blast in a completely satisfactory manner the surface on the leading and trailing face of the component or the top or cover plates located there. In accordance with a not previously published proposal (DE 40 39 621), this deficiency is remedied in that a deflecting device in the form of a wedge is introduced into the blast medium jet and deflects part of the jet in the conveying direction and the other part counter to this direction. With the partial jet directed against the conveying direction it is possible to blast the leading face or the top plate, whereas, the partial jet deflected in the conveying direction blasts the trailing face or top plate of the component. Thus, during blasting the deflecting wedge must twice be moved into the jet. As the deflecting wedge splits up the blast medium jet, there is only a 50% utilization thereof. It is also disadvantageous that the blast medium of the partial jet directed against the conveying direction remains on the workpiece and therefore hinders subsequent action on the surfaces.

SUMMARY OF THE INVENTION

The air of invention is to further develop a blasting plant having the aforementioned construction in such a way that there is an effective blasting of the leading and trailing face of the component or the top plates located there, together with all intermediate vertically or steeply positioned surfaces, e.g. web plates, etc.

According to the invention, the deflecting device is adjustable between an inoperative position outside the blast medium jet and an operative position deflecting the latter with respect to the vertical in the conveying direction, and in that at least one second deflecting device is provided, which is adjustable between an inoperative position outside the blast medium jet and an operative position deflecting same with respect to the vertical counter to the conveying direction.

For as long as the two deflecting devices are in the inoperative position, the uninfluenced blast medium jets of all the centrifugal blast wheels strike the component passing through the blast cabinet under the angle predetermined by the alignment thereof. Action takes place on the top and bottom, together with the lateral faces of the component. If the second deflecting device is in its operative position, then its blast medium jet deflected counter to the conveying direction is directed against the leading face or the top plate of the component, so that these are treated. This can take place at the entrance or exit of the blast cabinet. An arrangement of the deflecting device at the outlet offers the advantage that the component is completely blasted and the blast medium deflected counter to the conveying direction and which remains on the component can no longer disturb the blasting process. The trailing face or top plate is blasted by introducing the other deflecting device into the blast medium jet, which can once again take place at the entrance or exit. With both arrangements it is ensured that no deflected blast medium remains on untreated surfaces.

A second solution of the invention comprises at least one centrifugal blast wheel being positioned in such a way that its blast medium jet is inclined with respect to the vertical in the conveying direction and that the deflecting device is adjustable between an inoperative position outside the blast medium jet and an operative position deflecting the same with respect to the vertical against the conveying direction.

In this arrangement the blast medium jet of the at least one centrifugal blast wheel strikes the workpiece under an angle such that the blast medium is deflected in the conveying direction, so that it is exclusively left behind on those surfaces which have already passed through and been treated by the blast medium jet. Moreover, through the orientation of the blast medium jet of the said centrifugal blast wheel in the conveying direction after the passage of the component, the trailing face or top plate can be blasted. The impacting blast medium is deflected rearwards at the face. By adjusting the deflecting device in the blast medium jet of the same or a different centrifugal blast wheel, it can be deflected counter to the conveying direction and directed onto the leading face or the top plate, so that the latter is treated or cleaned. If the front face has already passed the blast medium jet, the deflecting device is returned to its inoperative position.

If the component has between the faces or the top plates other vertical or steep surfaces, e.g. welded-in web plates, brackets, etc., then their leading faces are treated by the blast medium jets inclined counter to the conveying direction and their trailing faces by those inclined in the conveying direction. In such a case the deflecting device is advantageously left in the operative position throughout the entire passage of the component.

According to the invention at least two deflecting devices, which deflect the blast medium jet in and opposite to the conveying direction, can be associated with a single centrifugal blast wheel or a group of such wheels located in a common plane, so that even in the case of a very short blast cabinet construction with only a single blast plane, it is possible to treat all the faces of the component, including the leading and trailing faces or top plates. Instead of this, it is also possible for at least two deflecting devices, which deflect the blast medium jet into and counter to the conveying direction to be associated with the different centrifugal blast wheels or two different groups of such wheels in each case arranged in a common plane.

In this construction in which there are consequently several blast planes, the deflecting device for blasting the leading face or top plate can be associated with the rear blast plane in the conveying direction, so that the blast medium deflected by it counter to the conveying direction can be left behind on the already blasted surfaces and does not hinder the blasting process. The deflecting device for treating the trailing face or top plate, which deflects the jet in the conveying direction, is preferably in the furthest forward blast plane in the conveying direction, i.e. passes into its operative position when the component is already completely located in the blast cabinet.

The deflecting device or devices can be associated with a single centrifugal blast wheel or a group of such wheels above the conveying means. In this case it is advantageous to adopt the previously described arrangement of the deflecting devices with respect to the entrance and exit of the blast cabinet.

Instead of this, it is also possible for at least one deflecting device to be associated with a centrifugal blast wheel or a group of such wheels below the conveying means.

When the deflecting device is located in the vicinity of the centrifugal blast wheels positioned below the conveying means, the positioning of the deflecting device with respect to the entrance and exit of the blast cabinet is unimportant, because the deflected blast medium jet is deflected upwards at the face or at the top plate and is always deflected away from the component and cannot pass onto the top of the component. Obviously it is possible to in each case associate one deflecting device with an upper and a lower centrifugal blast wheel. They can be arranged in such a way that they either both deflect the blast medium jet with respect to the conveying direction in the same direction or also in different directions. The first variant has the advantage that the corresponding face or top plate is blasted during a single passage once from top to bottom and once from bottom to top, so that a particularly effective treatment is obtained.

If, according to a further embodiment of the invention, all the centrifugal blast wheels are so arranged above the conveying means that their blast medium jets are inclined with respect to the vertical in the conveying direction, it is ensured that the reflected blast medium is not left behind on any blasted surfaces and that an effective treatment of the trailing face or top plate of the component is ensured. It is also only necessary to have a single deflecting device for the leading face or top plate.

A preferred embodiment of the invention is characterized in that the deflecting device, which deflects the blast medium jet against the conveying direction, has associated with it a servodrive, which leads the deflecting device into its operative position when the leading face of the component approaches the blast medium jet and returns it to its inoperative position after passing said jet. Such a servodrive is also associated with the deflecting device deflecting the blast medium jet in the conveying direction. It brings the deflecting device into the operative position on approaching the trailing face.

The servodrives move the deflecting device between the inoperative position outside the blast medium jet and the operative position in said jet. They can be hydraulic cylinders, electric motors, etc. They can be controlled manually or automatically, e.g. optoelectronically when the component enters the blast cabinet, so as to bring the deflecting device into the operative position and e.g. in time-delayed or path-dependent manner return it to its inoperative position.

The deflecting device can be mounted in pivotable or displaceable manner and the mounting support, like the servodrive, preferably is positioned outside the blast cabinet.

Advantageously the deflecting device has a replaceable baffle plate at least partly introduced into the blast medium jet in the operative position.

BRIEF DESCRIPTION OF THE DRAWINGS

The invention is described in greater detail hereinafter relative to a non-limitative embodiment with reference to the attached drawings, wherein.

DETAILED DESCRIPTION

Figure 1:
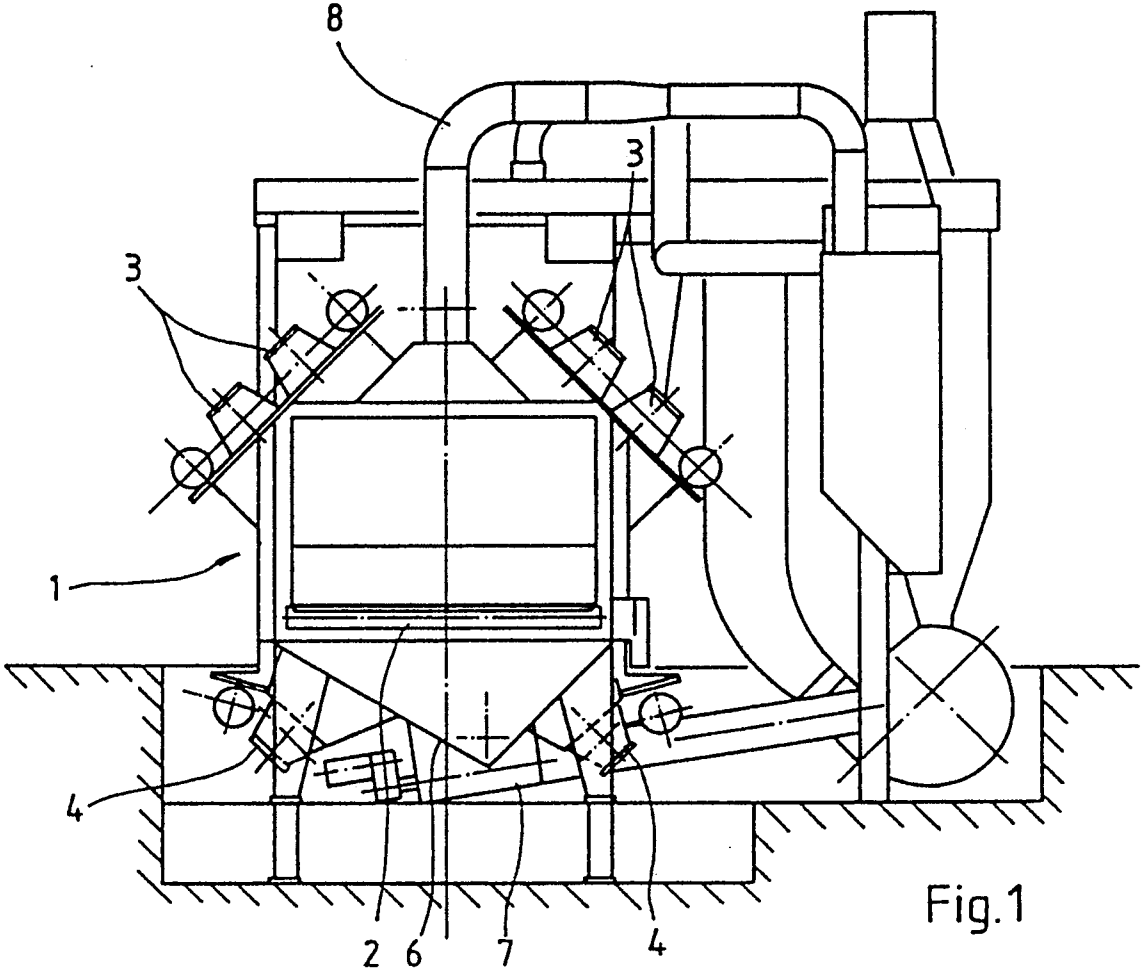
FIG. 1 is a front view of a blasting plant.

The blasting plant shown in FIG. 1 has a blasting cabinet 1 through which passes the conveyor or conveying means 2, which can e.g. be in the form of a roller train. In the upper area of the blast cabinet 1 there are several centrifugal blast wheels 3 in a plane roughly perpendicular to the conveying direction and whose blast medium jets are directed downwards in fan-like manner. In the same way in the lower area are provided centrifugal blast wheels 4, whose blast medium jets are directed upwards in fan-like manner. The base 6 of the blast cabinet 1 is tapered downwards in troughlike manner, so as to supply the used blast medium to a conveyor 7 for return to the blasting process. The plant parts diagrammatically indicated for the preparation of the blast medium are known and will not be described as they do not form part of the present invention. Finally, the blast cabinet 1 is provided with a dust extraction means 8. The preparation of the air also takes place in the plant parts which can be seen to the right. The upper centrifugal blast wheels 3 blast the top-exposed surfaces and lateral faces of the components, whereas, the lower centrifugal blast wheels 4 treat the downwardly directed faces and also the lateral faces. A large part of the blast medium is deflected sideways as a result of the inclined blast medium jets and passes via the troughlike base 6 into the conveyor 7. The same applies with regards to the blast medium striking the workpiece from the lower centrifugal blast wheels 4. If the blast medium is left behind on the component, it is blown off at the end of the blast cabinet and is also returned by the conveyor 7.

Figure 2:
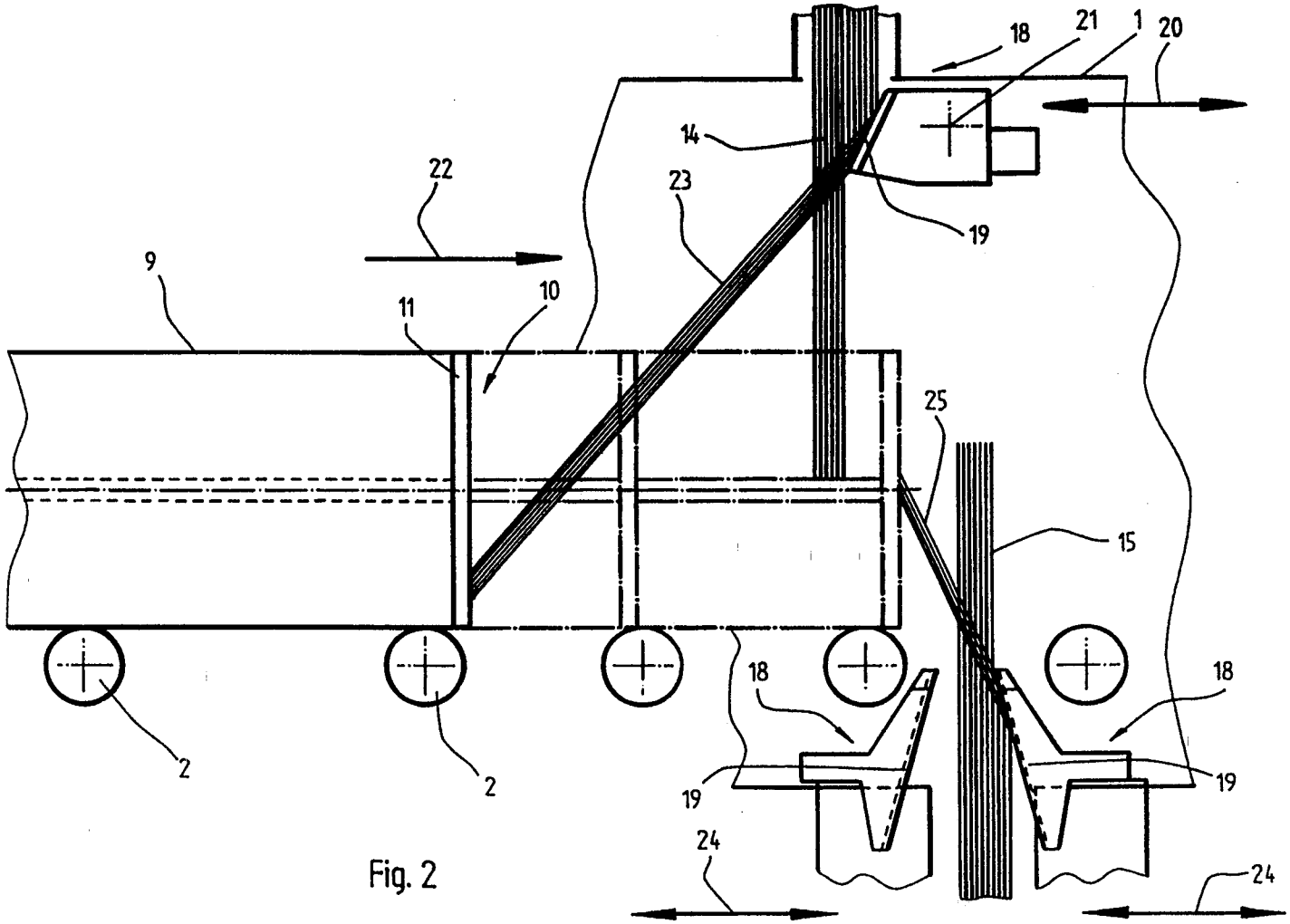
FIG. 2 A diagrammatic detail of the blasting plant with is a first phase of the blasting process.
Figure 3:
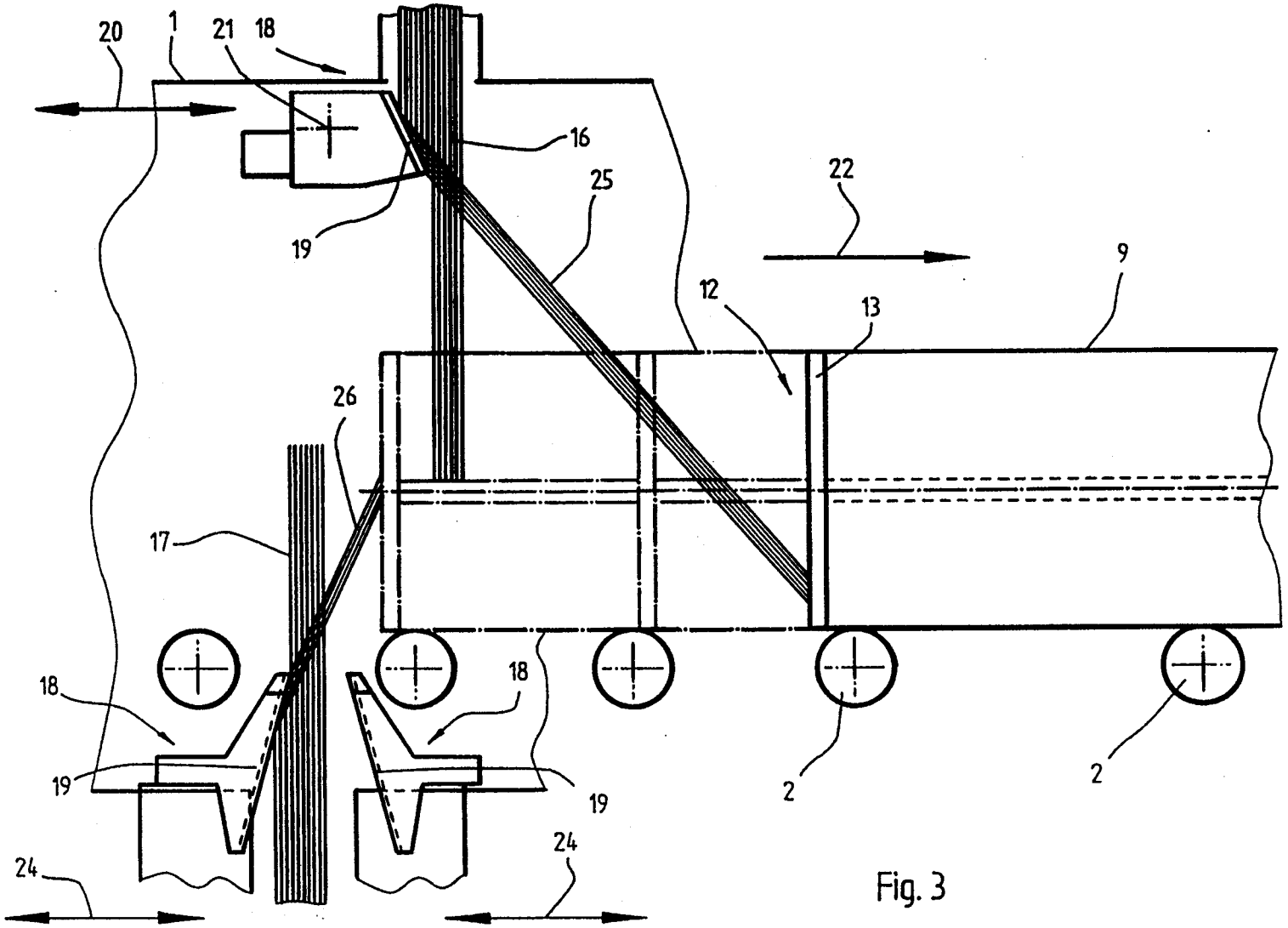
FIG. 3 is a detail similar to FIG. 2 of a second phase of the blasting process.

FIGS. 2 and 3 show a detail of the blast cabinet 1 and the conveying means 2 in the form of a roller train. On the roller train there is a component 9, e.g. in the form of a welded structure, which is provided at its leading face 10 with a top plate 11 and at its trailing face 12 with a top plate 13 (FIG. 3). FIG. 2 also shows a blast medium jet 14 from an upper centrifugal blast wheel 3 (FIG. 1) acting from above on the component 9 and a blast medium jet 15 of a lower centrifugal blast wheel 4 acting from below thereon. FIG. 3 also shows a blast medium jet 16 acting from above and a blast medium jet 17 acting from below. The centrifugal blast wheels producing the blast medium jets 14 and 15 according to FIG. 2 are arranged in a different vertical plane of the blast cabinet to the centrifugal blast wheels producing the blast medium jets 16 and 17 according to FIG. 3. For example, the arrangement according to FIG. 2 can be provided in the vicinity of the exit and that according to FIG. 3 in the vicinity of the entrance of the blast cabinet.

With the centrifugal blast wheel producing the blast medium jet 14 is associated a deflecting device 18, which has a baffle plate 19 and is linearly displaceable in accordance with the double arrow 20, so as to move linearly between the operative position shown in FIG. 2 within the blast medium jet 14 and a not shown inoperative position outside the blast medium jet 14. Instead of this the deflecting device can also be pivoted about its axis 21. The servodrive (not shown) is provided for this purpose and is preferably located outside the blast cabinet. In the operative position the blast medium jet 14 is deflected by the deflecting device 18 counter to the conveying direction 22. The deflected blast medium jet 23 strikes the top plate 11 of the component 9 running in the conveying direction 22. During the passage the top plate 11 is consequently blasted from bottom to top. Once the top plate 11 has passed the blast medium jet 23, then the deflecting device 18 is moved into its inoperative position.

The blast medium jet 15 acting from the bottom on the component 9 has two deflecting devices 18 associated with it and once again they can be linearly moved in accordance with the double arrow 24, so that through the deflecting device 18 shown to the right it is possible to produce a blast medium jet 25 directed onto the leading top plate 11 and which blasts from bottom to top the latter during the passage of the component 9.

FIG. 3 once again shows an upper and two lower deflecting devices 18, the upper deflecting device deflecting the blast medium jet 16 in the conveying direction, so that by the resulting blast medium jet 25 the trailing top plate is blasted from top to bottom, whereas through the lower deflecting device 18 to the left the blast medium jet 17 is deflected to form a jet 26, which blasts the top plate 13 from bottom to top.

The lower deflecting devices 18 in FIGS. 2 and 3 can fundamentally be identical, i.e. the blast medium jets 15, 17 can be produced by the same centrifugal blast wheel. It is also possible, in place of the arrangement of FIG. 3, to associate with the blast medium jet 14 from above according to FIG. 2, a second deflecting device acting from the opposite side, so that the blast cabinet can be made very short.

In a further variant of the embodiments according to FIGS. 2 and 3, only the upper or only the lower deflecting devices are present and they blast both the leading and the trailing face of the component 9. Finally it is also possible in place of the upper deflecting devices 18 to position the corresponding centrifugal blast wheels in such a way that the blast medium jets 14 produced by them are inclined in the conveying direction, so that they produce a jet roughly corresponding to the blast medium jet 25 and in this way not only act on the top of the component 9, but also on the trailing top plate 13.

If the component has web plates, brackets, etc. with vertical or approximately vertical surfaces between the faces 10, 12 then an upper and a lower deflecting device 18 with in each case different deflecting angles remain constantly in the operative position throughout the passage of the component.

We claim:

1. A blasting plant for elongated components comprising a blast cabinet, a conveyor for conveying the elongated components substantially horizontally through the blast cabinet, centrifugal blast wheels located below and above the blast cabinet for directing blast medium jets against the elongated components as the respective components are conveyed through the blast cabinet at least one deflecting device associated with at least one centrifugal blast wheel for deflecting the blast medium jet of said at least one centrifugal blast wheel, wherein the at least one deflecting device is adjustable between an inoperative position outside the blast medium jet and an operative position deflecting the blast medium jet with respect to a vertical plane in a conveying direction of the conveyor, and wherein at least one second deflecting device is associated with said at least one centrifugal blast wheel and is adjustable between an inoperative position outside the blast medium jet and an operative position deflecting the blast medium jet with respect to the vertical plane so as to direct the blast medium jet in a direction counter to a conveying direction of the conveyor.

2. A blasting plant according to claim 1, wherein at least two second deflecting devices are provided for deflecting the blast medium jet counter to the conveying direction of the conveyor, said at least two second deflecting devices are associated with one of the single centrifugal blast wheel or a group of centrifugal blast wheels located in a common plane.

3. A blasting plant according to claim 1, wherein at least two second deflecting devices are provided for deflecting the blast medium jet counter to the conveying direction of the conveyor, said at least two second deflecting devices being associated with one of different centrifugal blast wheels or two different groups of centrifugal blast wheels located in a common plane.

4. A blasting plant according to claim 1, wherein each of said deflecting devices is pivotably mounted.

5. A blasting plant according to claim 1, wherein each of said deflecting devices is displaceably mounted.

6. A blasting plant for elongated components comprising a blast cabinet, a conveyor for conveying the respective elongated components substantially horizontally through the blast cabinet, centrifugal blast wheels disposed below and above the blast cabinet for directing blast medium jets against the elongated components as the respective elongated components are conveyed through the blast cabinet, at least one deflecting device associated with at least one centrifugal blast wheel for deflecting the blast medium jet of said at least one centrifugal blast wheel, said at least one centrifugal blast wheel is positioned in such a way that the blast medium jet is inclined relative to a vertical plane in a conveying direction of the conveyor, and wherein the deflecting device is adjustable between an inoperative position outside the blast medium jet and an operative position deflecting the blast medium jet with respect to the vertical plane so as to deflect the blast medium jet in a direction counter to a conveying direction of the conveyor.

7. A blasting plant according to one of claims 1 or 6, wherein at least one deflecting device is associated with one of a centrifugal blast wheel or a group of centrifugal blast wheels above the conveyor.

8. A blasting plant according to one of claims 1 or 6, wherein at least one deflecting device is associated with one of a centrifugal blast wheel or a group of centrifugal blast wheels below the conveyor.

9. A blasting plant according to one of claims 1 or 6, wherein a servo drive is associated with each deflecting device for deflecting the blast medium jet in the direction counter to the conveying direction of the conveyor, and wherein the servo drive moves the deflecting device into the operative position when a leading phase of the elongated component approaches the blast medium jet and returns the deflecting device to the inoperative position when the elongated element passes said blast medium jet.

10. A blasting plant according to one of claims 1 or 6, wherein a servo drive is associated with each deflecting device for deflecting the blast medium jet in the conveying direction of the conveyor, and wherein the servo drive moves the deflecting device into the operative position when a trailing face of the elongated component approaches the blast medium jet and returns the deflecting device to the inoperative position when the elongated component passes the blast medium jet.

11. A blasting plant according to one of claims 1 or 6, wherein each of the deflecting devices includes a replaceable baffle plate at least partially immersed in the blast medium jet when the deflecting device is in the operative position.

* * * * *